US012065232B1

(12) United States Patent
Marohl et al.

(10) Patent No.: US 12,065,232 B1
(45) Date of Patent: Aug. 20, 2024

(54) WATERSPORTS BOAT WITH ENHANCED WAKE GENERATION CHARACTERISTICS AND RELATED METHODS AND SYSTEMS

(71) Applicant: Correct Craft IP Holdings, LLC, Orlando, FL (US)

(72) Inventors: Aaron M. Marohl, Saint Cloud, FL (US); Eric J. Miller, Orlando, FL (US); Christopher J. Grueber, Athens, TN (US); Jonathan R. Hampton, Sweetwater, TN (US); Randy E. McDaniel, Madisonville, TN (US); Carl D. Welshan, Vonore, TN (US)

(73) Assignee: CORRECT CRAFT IP HOLDINGS, LLC, Orlando, FL (US)

( * ) Notice: Subject to any disclaimer, the term of this patent is extended or adjusted under 35 U.S.C. 154(b) by 443 days.

(21) Appl. No.: 17/337,537

(22) Filed: Jun. 3, 2021

Related U.S. Application Data

(60) Provisional application No. 63/088,224, filed on Oct. 6, 2020.

(51) Int. Cl.

| | |
|---|---|
| ***B63H 21/21*** | (2006.01) |
| ***B63B 1/04*** | (2006.01) |
| ***B63B 32/10*** | (2020.01) |
| ***B63B 32/50*** | (2020.01) |
| ***B63B 79/40*** | (2020.01) |

(52) U.S. Cl.
CPC ..... *B63H 21/21* (2013.01); *B63B 1/04* (2013.01); *B63B 32/10* (2020.02); *B63B 32/50* (2020.02); *B63B 79/40* (2020.01); *B63H 2021/216* (2013.01)

(58) Field of Classification Search
CPC ..... B63B 34/70; B63B 34/75; B63B 1/04; B63B 32/10; B63B 32/50; B63B 79/40; B63B 1/22; B63H 21/21; B63H 2021/216
See application file for complete search history.

(56) References Cited

U.S. PATENT DOCUMENTS

| | | | | |
|---|---|---|---|---|
| 8,578,873 | B2 | 11/2013 | Gasper et al. | |
| 9,545,977 | B1 | 1/2017 | Swiatek | |
| 9,802,684 | B2 * | 10/2017 | Sheedy | B63B 32/70 |
| 2008/0271660 | A1 * | 11/2008 | Zsido | B63B 34/75 114/285 |
| 2014/0261135 | A1 * | 9/2014 | Gasper | B63B 13/00 114/284 |

OTHER PUBLICATIONS

Alan Jones; Forward Thinking; BoatingWorld Magazine; Jun. 1, 2015; https://www.boatingworld.com/engines/bw-06-2015-engines-forward-thinking/.

Volvo Penta; Powertrim Assistant Turn on and Forget; Mar. 2017; www.volvopenta.com.

* cited by examiner

*Primary Examiner* — Andrew Polay
(74) *Attorney, Agent, or Firm* — Allen, Dyer, Doppelt + Gilchrist, PA

(57) ABSTRACT

A watersports boat is equipped with a trimmable drive used to generate a virtual ballast effect. Turbulence experienced by a wake rider on startup is reduced by automatically varying the drive orientation as the watersports boat comes up to speed. A pair of water channelers are located at the stern. One of the water channelers is deployed below the running surface to redirect water across centerline and improve wake shape on the selected side.

19 Claims, 6 Drawing Sheets

Fig. 2
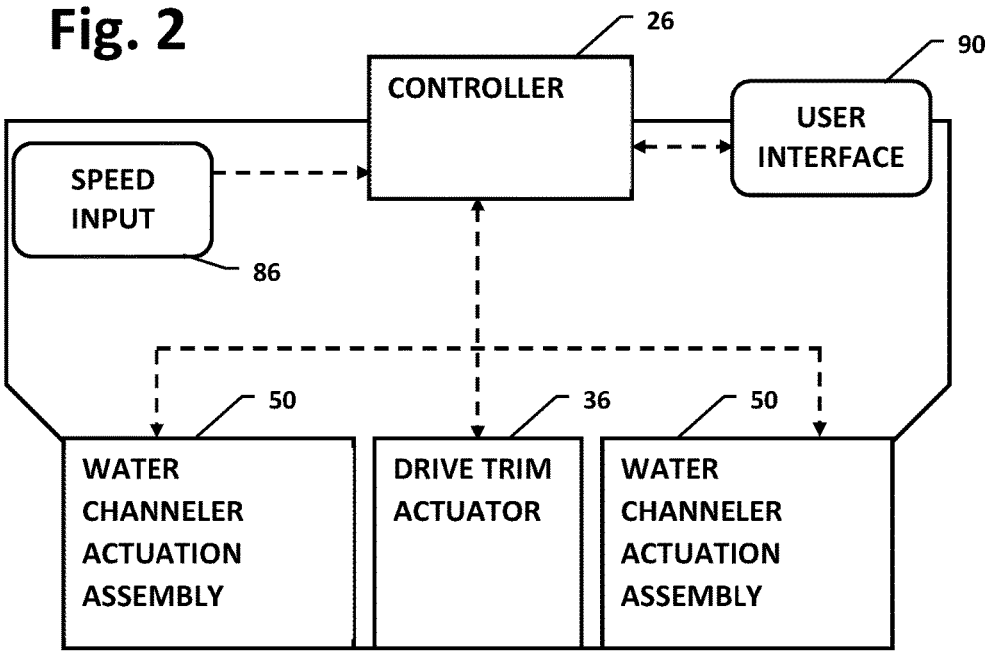
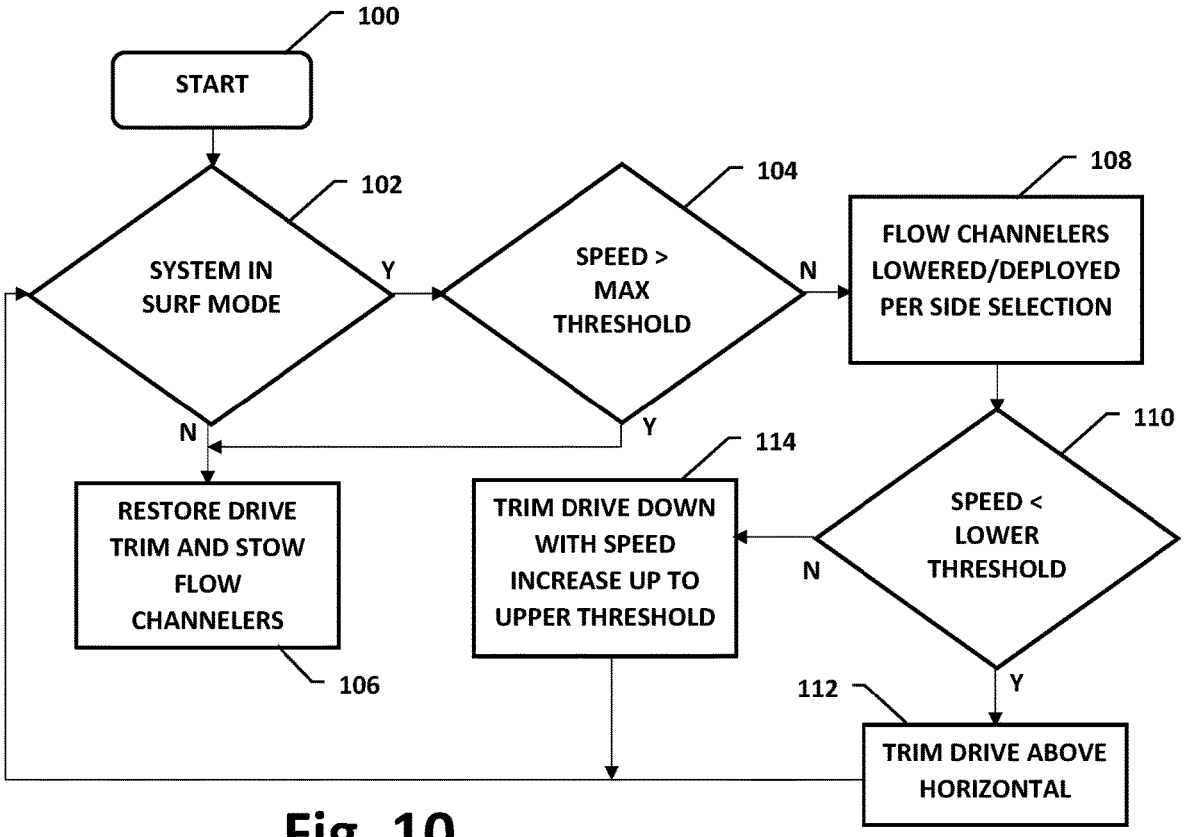
Fig. 10

WATERSPORTS BOAT WITH ENHANCED WAKE GENERATION CHARACTERISTICS AND RELATED METHODS AND SYSTEMS

CROSS-REFERENCE TO RELATED APPLICATION

This application claims the benefit of U.S. Provisional Patent Application Ser. No. 63/088,224, filed on Oct. 6, 2020, the contents of which are herein incorporated by reference in their entirety.

FIELD OF THE INVENTION

The present invention relates to watersports boats equipped with systems for improving characteristics of a wake generated thereby for use in various watersports, and more particularly to watersports boats used for wake surfing.

BACKGROUND OF THE INVENTION

It is recognized that ballasting the stern of a watersports boat so that it sits lower in the water can create a wake having more desirable characteristics for watersports. For example, a larger, more wave-like, wake can be achieved for wake surfing by adding ballast to the stern of the side being surfed. On a very basic level, this can be achieved by physically adding extra weight (e.g., in the form of ballast bags filled with water) to the desired area of the watersports boat. However, many watersports boats now feature built-in ballast systems, with multiple tanks that can be filled and drained with water via one or more pumps and through-hull connections.

Such ballast systems make ballasting much more convenient for the user. However, it can still require an appreciable period of time to fill the ballast tanks once the boat is in the water and in a desired location for watersports operations. Likewise, draining the tanks for more efficient cruising or for removal of the boat from the water can also require an appreciable amount of time.

The amount of ballast required to achieve a desired stern position is further increased by the use of inboard drives. Inboard drives have historically been used for watersports boats as opposed to outboard or stern drives because the inboard drive propeller position is much safer for the rider. However inboard drives are not typically trimmable and are oriented such that a lifting force is generated on the stern.

More recently, watersports boats have been equipped with forward drives (essentially a stern drive with the propeller(s) forward of the gearbox). Forward drives offer safety comparable to an inboard drive while still affording the enhanced low speed maneuverability and the ability to adjust trim using the drive. However, current uses of forward drives still involve significant additional ballasting and also generate turbulence that can make it much more difficult to for a rider to initially get up on his or her board from a water start. Additionally, even with the use of water ballast, further improvements in the shape of the wake remain desirable.

SUMMARY OF THE INVENTION

In view of the foregoing, it is an object of the present invention to provide a watersports boat reducing or eliminating the need for water ballast and having improved wake shaping characteristics. According to an embodiment of the present invention, a watersports boat includes a hull having a running surface and extending between a bow and a stern.

A drive is mounted at the stern and has a drive orientation trimmable through a range from above to below horizontal. A controller located in the boat has at least one microprocessor and machine-readable memory receiving a boat speed input. The controller is configured with program instructions to automatically adjust the drive orientation from above to below horizontal while the boat speed is in increased with the controller in a "surf mode" of operation.

According to another embodiment of the present invention, a watersports boat includes a transverse water channeling system. The water channeling system has a pair of water channelers and a pair of actuation assemblies. The pair of water channelers are mounted at the stern on opposite sides of a centerline of the hull, each of the water channelers including at least a first sidewall angled such that a trailing edge is closer to the centerline than a leading edge, each of the water channelers mounted to the stern so as to be independently movable from a stowed position to a deployed position at least partially below the running surface such that the first sidewall redirects water impinging thereon across the centerline. Each actuation assembly is operable to move a respective one of the water channelers between the stowed and deployed positions. The controller being configured with program instructions to operate the actuation assembly to move the water channeler on a selected side into the deployed position.

According to a method aspect, a method of operating a trimmable drive on a watersports boat includes automatically adjusting a drive orientation of the trimmable drive to above horizontal with a controller on the watersports boat in a "surf mode" of operation and receiving a boat speed input indicative of the boat speed being below a lower speed threshold. With the controller in the "surf mode" of operation and with the boat speed input indicative of the boat speed exceeding the lower speed threshold, the drive orientation is automatically adjusted to below horizontal.

According to another method aspect, a method of wake shaping for a watersports boat includes selecting a side of the watersports boat for surfing, and deploying a wake channeler on the selected side such that a sidewall of the wake channeler is angled to redirect water impinging thereon across a centerline of the watersports boat.

These and other objects, aspects and advantages of the present invention will be better appreciated in view of the drawings and following detailed description of preferred embodiments.

BRIEF DESCRIPTION OF THE DRAWINGS

FIG. 2 is a schematic overview of the components of the watersports boat of FIG. 1;

FIG. 10 is a flow diagram of operations of the watersports boat of FIG. 1 to enhance wake characteristics.

DETAILED DESCRIPTION OF PREFERRED EMBODIMENTS

Figure 1:
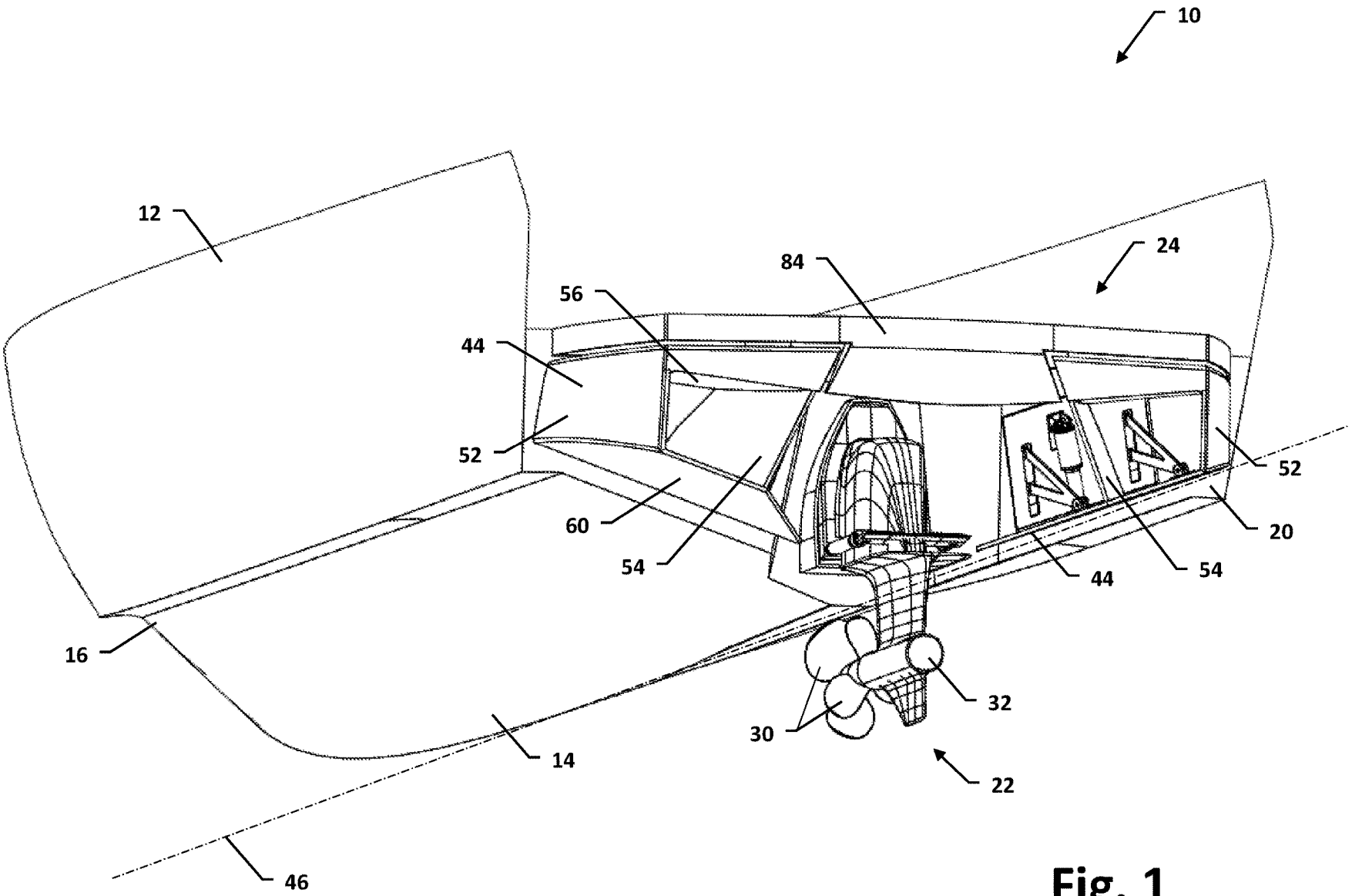
FIG. 1 is a perspective view of watersports boat including a trimmable drive and a transverse water channeling system, according to an embodiment of the present invention.

According to an embodiment of the present invention, referring to FIGS. 1 and 2, a watersports boat 10 has a hull 12 within a running surface 14 extending between a bow 16 and a stern 20. A drive 22 and a transverse water channeling system 24 are located at the stern 20 and operable via a controller 26 to improve watersports characteristics of a wake generated by the hull 12.

In the depicted embodiment, the drive 22 is a forward drive having a one or more propellers 30 located forwardly of a gear box 32. Unlike a conventional inboard drive, the drive 22 is trimmable, meaning that its drive orientation 34 (see FIG. 3) can be varied via the operation of trim actuator 36. While the present invention is not necessarily limited to a forward drive, it is preferred for watersports safety that the drive configuration does not place the propeller(s) rearwardly of the stern. For example, a trimmable pod drive mounted to the bottom of the hull 12 at the stern would be another suitable type of drive, while conventional stern drives and outboard motors are non-preferred. Additionally, while a single drive positioned along the centerline is shown, it will be appreciated the present invention could be implemented with boats having two or more drives.

Figure 3:
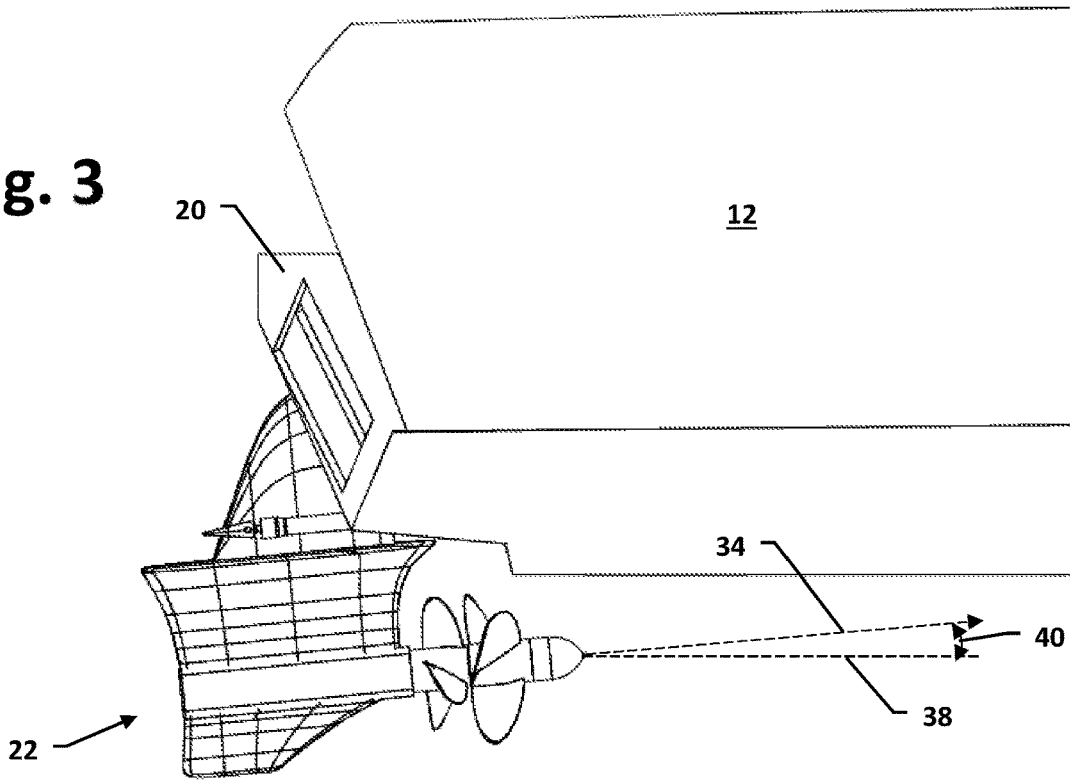
FIG. 3 is a partial side view of the watersports boat of FIG. 1, with the water channeling system hidden and the trimmable drive having a drive orientation above horizontal.
Figure 4:
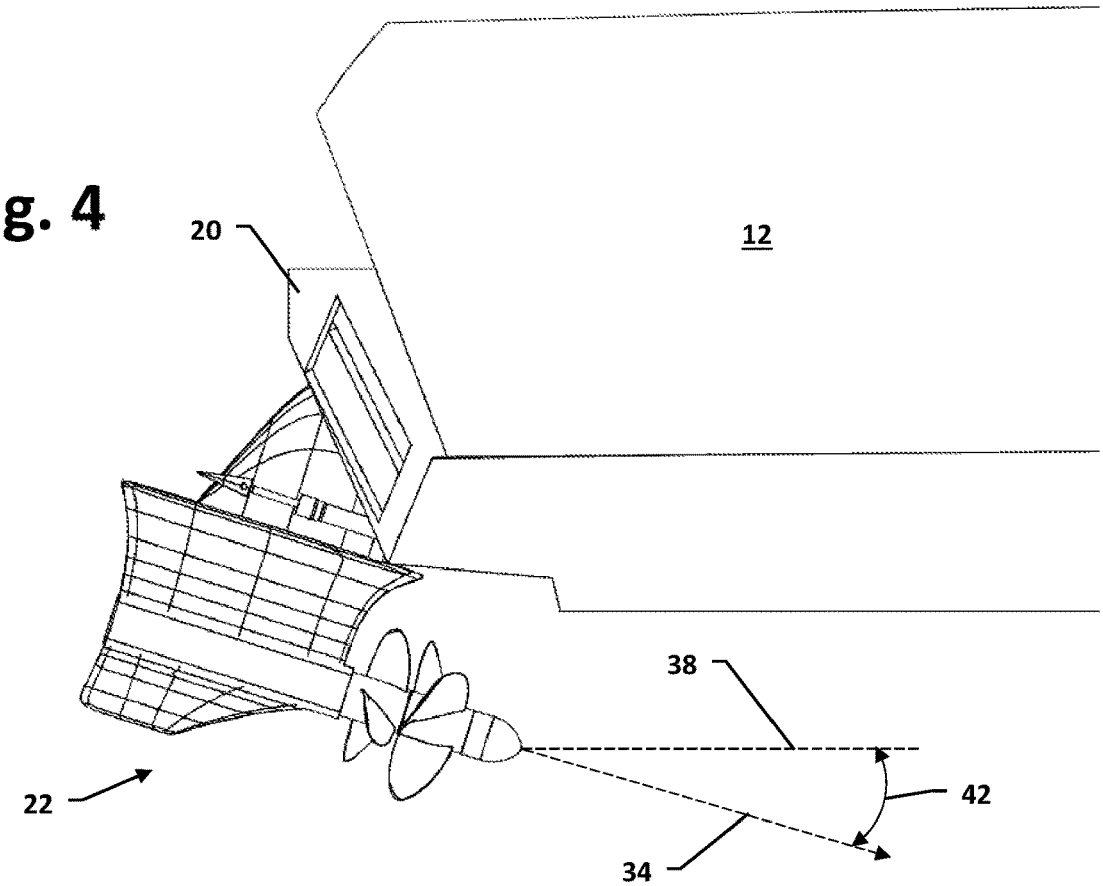
FIG. 4 is a partial side view of the watersports boat of FIG. 1, with the water channeling system hidden and the trimmable drive having a drive orientation below horizontal.

Referring to FIGS. 3 and 4, the drive orientation 34 is preferably variable from above horizontal (as in FIG. 3) to below horizontal (as in FIG. 4). As used herein, the term "drive orientation" refers to the orientation, relative to a horizontal plane 38, along which the force of the drive 22 is directed when operating to drive the boat forward (as opposed to when operating in reverse). Advantageously, the drive 22 is trimmable from an angle 40 above the horizontal plane 38 of approximately one to five degrees to an angle 42 below the horizontal plane 38 of approximately ten to twenty-five degrees, with the full range of five degrees above horizontal to twenty-five degrees below horizontal being most preferred.

Figure 5:
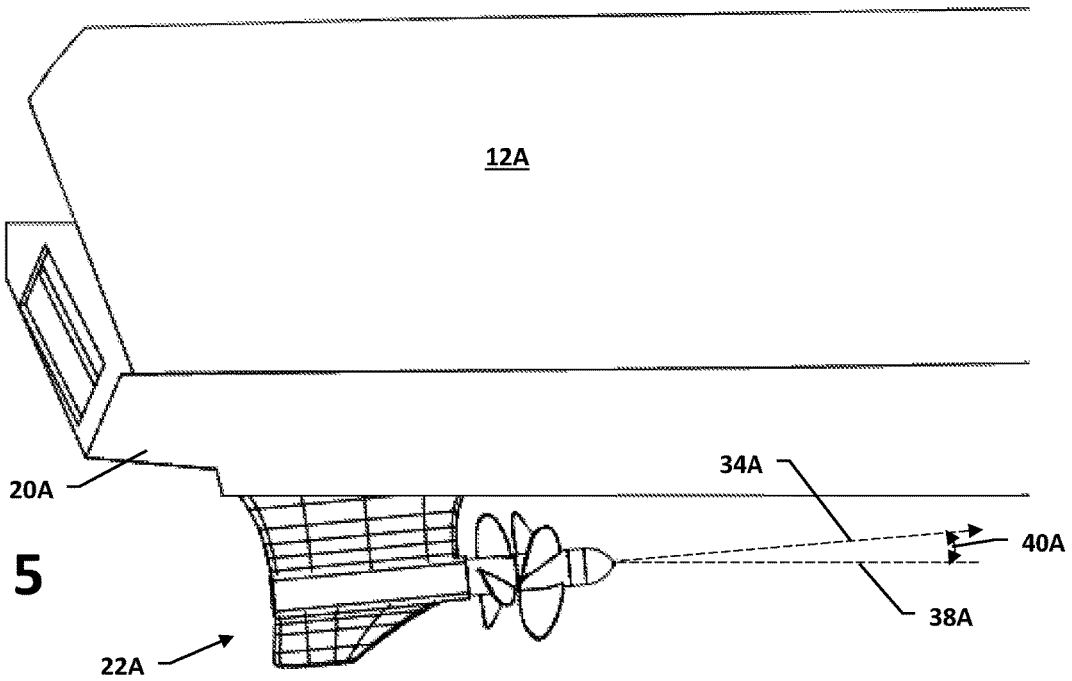
FIGS. 5 and 6 are partial side views of an alternate embodiment of the watersports boat in FIGS. 3 and 4, equipped with a pod drive.
Figure 6:
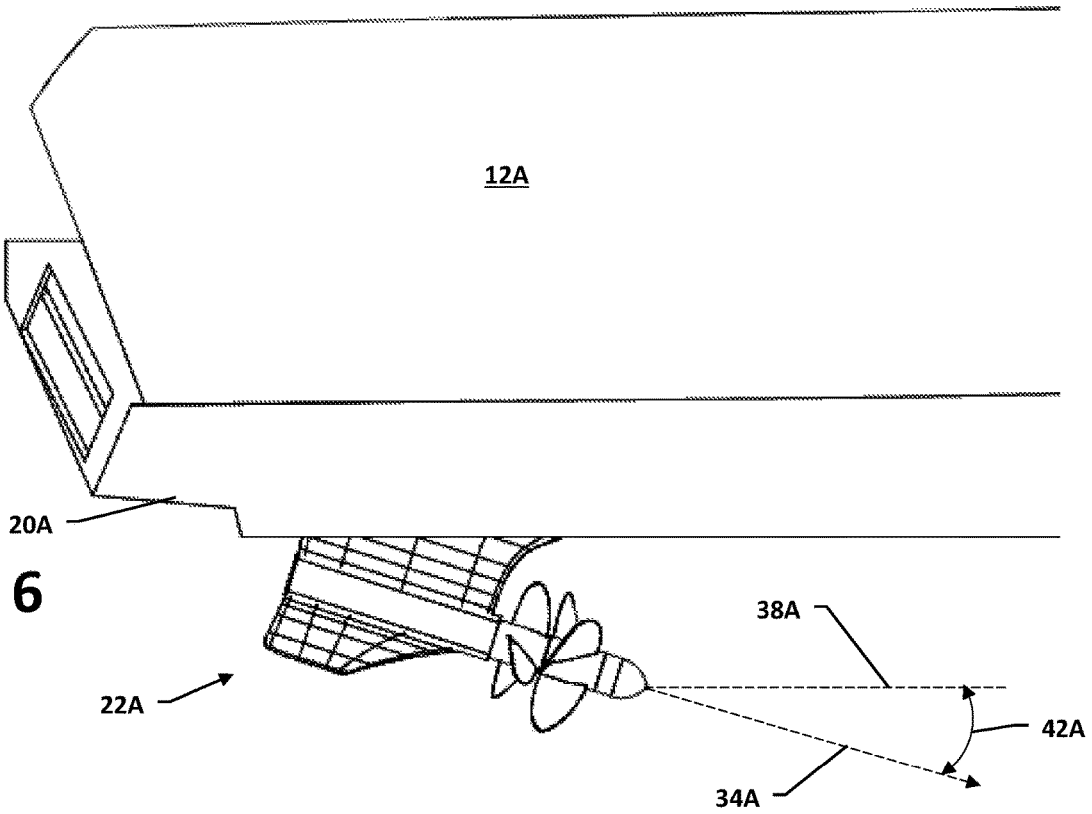

As mentioned above, other trimmable drives could be used in connection with the present invention. In FIGS. 5 and 6, a trimmable pod drive 22A is connected at the stern 20A of the hull 12A. Like the forward drive 22, the pod drive 22A is trimmable between an angle 40A above the horizontal plane 38A and an angle 42A below the horizontal plane 38A. The full range between the angles 40A and 42A could be the same or similar to that the angles 40 and 42, or utilize some subset or overlapping range thereof. For instance, a trimmable pod drive might advantageously utilize a smaller angular range in combination with some ballast addition.

Figure 7:
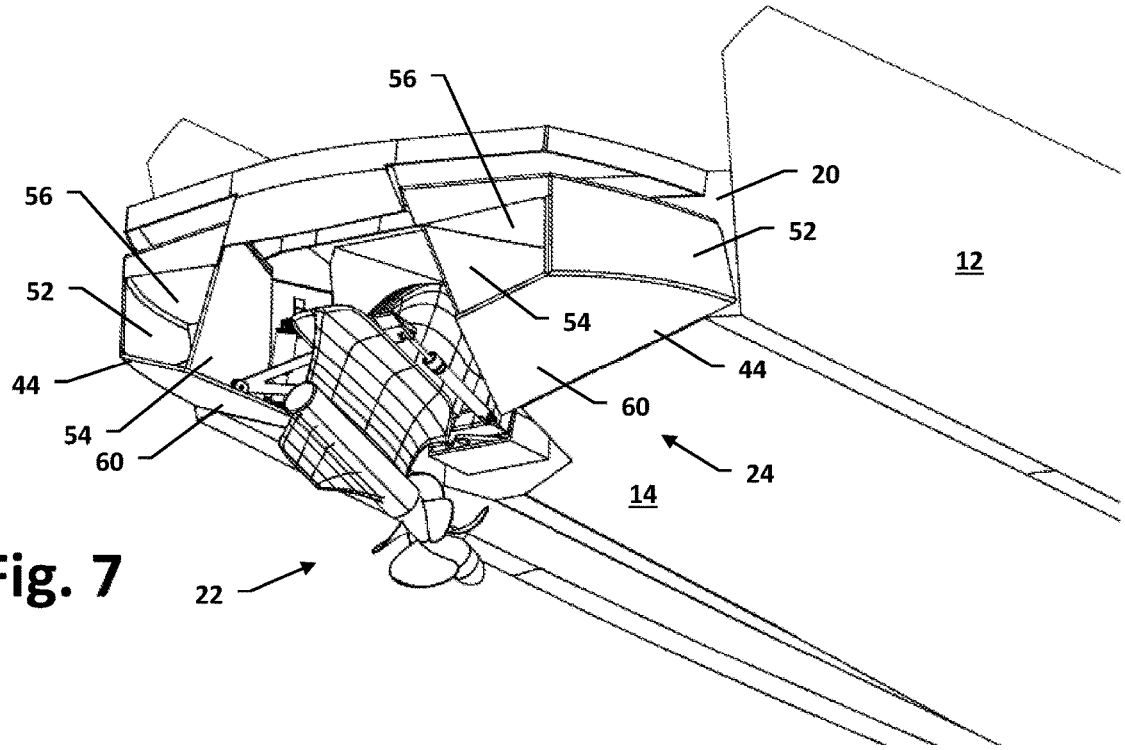
FIG. 7 is a partial perspective view of the watersports boat of FIG. 1, with water channelers of the water channeling system in a lowered position.
Figure 8:
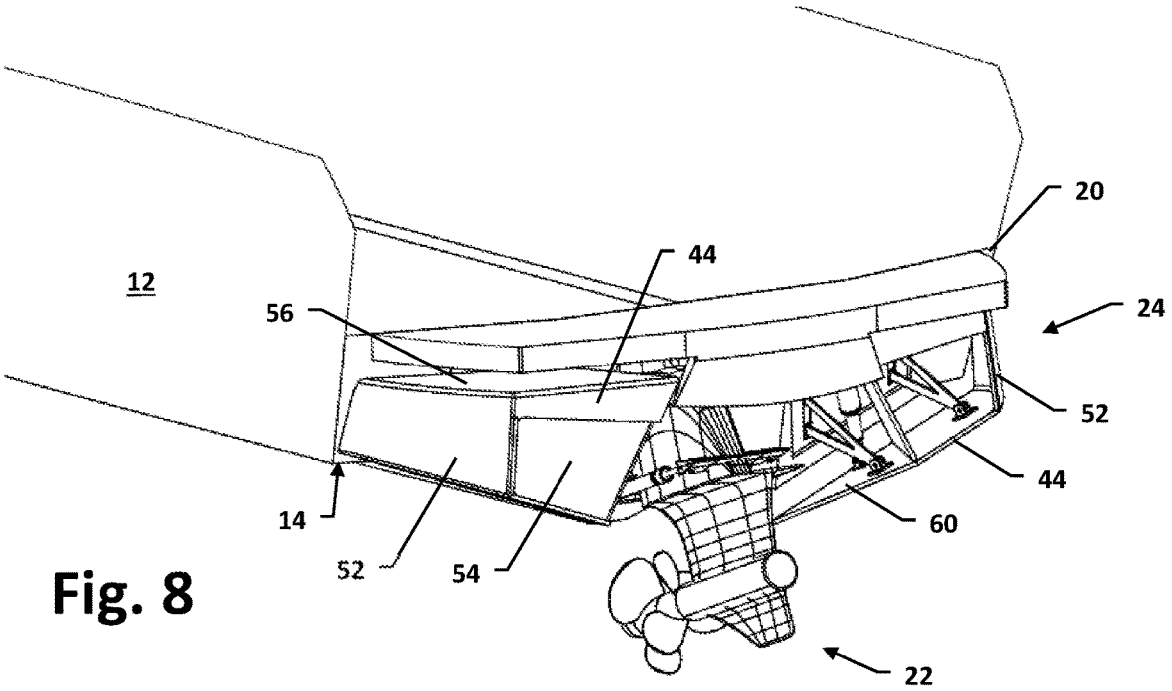
FIG. 8 is a partial perspective view of the watersports boat of FIG. 1, with water channelers of the water channeling system in the lowered position and a starboard water channeler deployed.

Referring again to FIG. 1, as well as to FIGS. 7 and 8, the transverse water channeling system 24 includes a pair of water channelers 44 mounted at the stern 20 on opposite sides of a hull centerline 46 and are independently operable by the controller via actuation assemblies 50 (see FIG. 2). In the depicted embodiment, the water channelers 44 and actuation assemblies 50 are mirror images but otherwise structurally and functionally identical. It will be appreciated, however, that asymmetries between the sides of the water channeling system could intentionally be introduced; for instance, to accommodate bias in the drive.

Each water channeler includes first and second sidewalls 52, 54 that are both angled such that trailing edges are closer to the centerline 46 than the leading edges. Consequently, when deployed at least partially below the running surface 14 (as the starboard water channeler 44 is in FIG. 6), each water channeler 44 will redirect water impinging thereon across the centerline 46. For structural integrity and a more directed channeling of water, each water channeler 44 includes first and second cross walls 56, 60 connected across upper and lower edges of the sidewalls 52, 54. A water channeler could also potentially be implemented as just a single sidewall or a pair of sidewalls.

Figure 9:
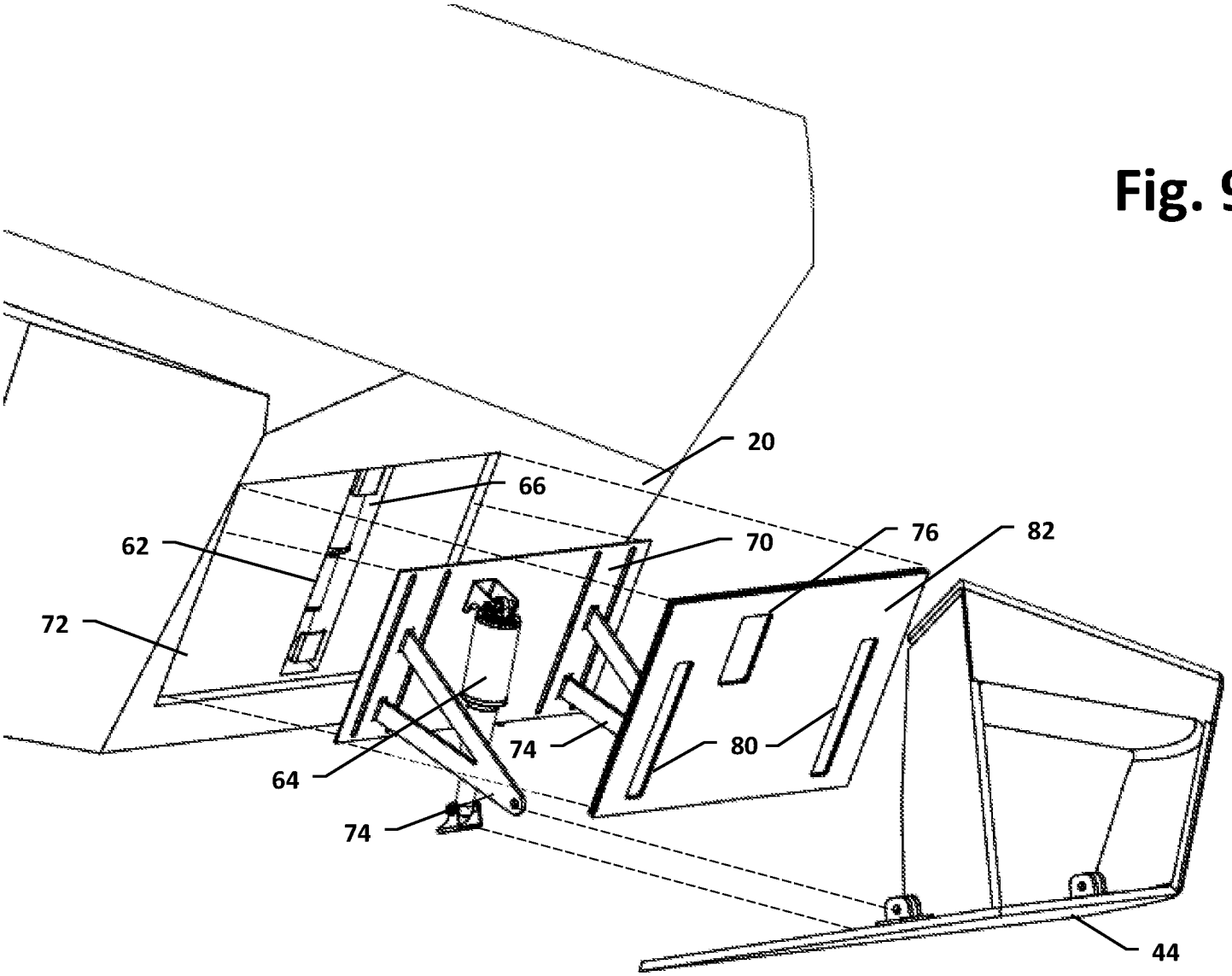
FIG. 9 is a partially exploded view of one side of the water channeling system of the watersports boat of FIG. 1.

Referring to FIG. 9, each actuation assembly 50 (only the starboard assembly 50 being shown, with the port assembly 50 being a mirror image thereof) includes a pair of linear actuators 62, 64 that act between the stern 20 and the water channeler 44. The linear actuator 62 is mounted in an actuator recess 66 in the stern 20 and is connected to an intermediate plate 70 slidably seated in a plate recess 72 such that the actuator 62 is operable to slide the intermediate plate 70 up and down therein.

The linear actuator 64 is connected to the intermediate plate 70 along with hinge arms 74 which extend through respective openings 76, 80 in a cover plate 82 and connect to the water channeler 44. The cover plate 82 retains the intermediate plate 70 in the plate recess 72. The hinge arms 74 are pivotably connected to the water channeler 44 such that the actuator 64 is operable to pivot a leading edge of the water channeler below a trailing edge (as is seen with the starboard channeler 44 in FIG. 8).

With the actuators 62, 64 collectively acting between the stern 20 and each of the water channelers 44, each actuation assembly 50 is operable by the controller 26 to raise and lower, as well as to pivot, its water channeler 44. In the depicted embodiment, referring particularly to FIG. 1, in a stowed position, the leading edges of both water channelers 44 are pivoted up and both water channelers 44 are raised to sit closely under a swim platform 84. More particularly, lower ends of both water channelers 44 are raised completely above adjacent portions of the running surface 14 at the stern 20, so as not to interfere with water flow during normal cruising.

In FIG. 7, the water channelers 44 are both lowered so as to be substantially flush with the adjacent portions of the running surface 14 at the stern and ready for full deployment. In FIG. 8, the starboard water channeler 44 is deployed with its leading edge pivoted down such that the sidewalls 52, 54 extend at least partially below the adjacent portion of the running surface 14 and will redirect water impinging thereon. Generally, however, the function of the actuation assemblies 50 is to move the water channelers 44 between a stowed position where the sidewalls 52, 54 do not extend below the running surface and deployed position where they do. This could also be accomplished, for example, by actuation assemblies that only raised and lowered the water channelers or that only pivoted the water channelers.

Referring again to FIG. 2, the controller 26 is preferably a microprocessor device having programmable, machine-readable memory. The controller 26 can be executed by multiple microprocessors, with controller 26 functions being shared between microprocessors in different locations of the boat 10. The controller 26 receives a speed input 86 and communicates with a user interface 90.

The speed input 86 is indicative of a speed of the watersports boat 10 and preferably is generated based on an operating speed of the drive 22. However, it will be appreciated that other speed inputs could be used, such as a water speed sensor or speed derived from a global positioning system (GPS) or other navigational system.

The user interface 90 is preferably a touch screen with a graphical user interface, although any suitable user interface could be used. For the purposes of the present invention, the user interface 90 allows a user to place the controller 26 in a "surf mode" of operation and to select a side of the boat 10 for wake surfing or similar wake-related activities. The term "surf mode" is used herein simply to refer to an operational mode of the controller 26 where it will implement the controls of the drive 22 and water channeling system 24 described herein to improve wake characteristics. The use of the term "surf mode" does not require that a given implementation actually use that name for the operational mode nor that anyone actually engage in wake surfing with the controller 26 in that operational mode.

Referring to FIG. 10, a method of enhancing wake characteristics starts at block 100. At block 102, if the system is in surf mode, the controller 26 determines (at block 104) whether the speed input 86 indicates a boat speed in excess of a maximum threshold. The maximum speed threshold, can be established based on various mechanical and/or operational criteria. For example, a maximum speed threshold can be set to provide a margin to avoid damage to deployed components of the water channeling system 24 and/or as indicative of a speed above which a user is likely to have resumed cruising while forgetting to disengage the "surf mode." A maximum speed threshold of thirteen miles per hour (mph) is one suitable example.

Whenever the maximum speed threshold is exceeded, the controller 26 automatically restores normal drive trim at block 106 (e.g., to whatever trim was manually selected before the user entered "surf mode" or based on an automatically selected cruising trim) and stows the flow channelers 44 (in the position shown in FIG. 1). If a user is determined to have exceeded the maximum speed threshold in "surf mode," the controller can either automatically resume "surf mode" once speed drops below the threshold or require the user to affirmatively re-engage "surf mode."

If, at block 104, speed is less than the maximum speed threshold, then the controller lowers both the flow channelers 44 and deploys the flow channeler on the selected side at block 108. If the flow channelers 44 were already lowered and/or deployed in an earlier iteration of the method, then their status is simply maintained. By directing water across centerline 14 away from the side to be surfed, the water channeling system advantageously "cleans" the leading edge of the boat wake on that side, creating a more optimal form for surfing. It should be noted that this is contrary to the principle of operation for existing wake enhancement devices that work by rechanneling flow, which operate to direct water away from centerline on the side being surfed (see, e.g., U.S. Pat. Nos. 8,578,873, 9,545,977).

At block 110, the controller 26 determines whether the speed input 86 indicates speed is below a lower speed threshold. The lower speed threshold is used by the controller 26 to ensure that prop wash from the drive 22 is directed downward and away from a rider as the boat 10 begins to throttle up and increase speed. Consequently, if speed is below the lower speed threshold, the controller 26 automatically adjusts the trim of the drive 22 at block 112 such that the drive orientation 34 is above horizontal (as in FIG. 3).

Once the speed input 86 indicates boat speed is above the lower speed threshold, the controller 26 begins trimming the drive down at block 114. The results in a drive orientation that is below horizontal (as in FIG. 4), which drives the stern 20 lower in the water simulating the adding water ballast or otherwise adding weight to the stern 20. Advantageously, however, this virtual ballast can be added (or removed) almost instantaneously and eliminates or reduces the space and associated structures required by ballasting systems.

Preferably, the controller 26 is configured to gradually lower the drive orientation from the lower speed threshold up to an upper speed threshold. The following Table illustrates an advantageous control profile from a lower speed threshold of seven mph to an upper speed threshold of 11 mph.

BOAT SPEED - DRIVE ORIENTATION PROFILE

| Speed (mph) | Drive Orientation (degrees Above or Below Horizontal) |
|---|---|
| 0 | 5A |
| 1 | 5A |
| 2 | 5A |
| 3 | 5A |
| 4 | 5A |
| 5 | 5A |
| 6 | 5A |
| 7 | 5A |
| 8 | 1A |
| 9 | 5B |
| 10 | 11B |
| 11 | 18B |

While it is advantageous to combine the above-described operation of the trimmable drive with the water channeling system—for instance, channeling flow away from the side to be surfed also helps to minimize drive turbulence experienced by a rider on startup, it will be appreciated that either could be used on a watersports boat independently of the other.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A watersports boat comprising:

a hull having a running surface and extending between a bow and a stern;

a transverse water channeling system, the transverse water channeling system including:

a pair of water channelers mounted at the stern on opposite sides of a centerline of the hull, each of the water channelers including a first sidewall angled such that a trailing edge is closer to the centerline than a leading edge, a second sidewall spaced apart from the first side wall and angled like the first side wall, and first and second cross walls connected, respectively, to upper and lower ends of the first and second side walls, each of the water channelers mounted to the stern so as to be independently movable from a stowed position to a deployed position at least partially below the running surface such that water passing between the first and second sidewalls in the deployed position is redirected across the centerline; and a pair of actuation assemblies, each actuation assembly operable to move a respective one of the water channelers between the stowed and deployed positions;

a controller located in the boat including at least one microprocessor and machine-readable memory receiving a side selection input, the controller being configured with program instructions to operate the actuation assembly to move the water channeler on a selected side into the deployed position.

2. The watersports boat of claim 1, wherein each of the water channelers is pivotably connected to the stern such that a leading of edge of the water channeler is pivotable below a trailing edge of the water channeler; and wherein the actuation assembly includes a first actuator operating between the stern and the water channeler to pivot the water channeler.

3. The watersports boat of claim 1, further comprising:

a drive mounted at the stern and having a drive orientation trimmable through a range from above to below horizontal; and wherein the controller receives a boat speed input and is configured to automatically adjust the drive orientation from above to below horizontal while a forward drive speed is increased with the controller in a "surf mode" of operation.

4. The watersports boat of claim 3, wherein the drive is a forward drive.

5. The watersports boat of claim 3, wherein the drive is a pod drive.

6. The watersports boat of claim 3, wherein the controller is configured to automatically adjust the drive orientation from above to below horizontal while the boat speed is increased with the controller in the "surf mode" of operation.

7. The watersports boat of claim 6, wherein the controller is configured to automatically adjust the drive orientation while the boat speed is increased with the controller in the "surf mode" of operation from an initial angle of approximately one to five degrees above horizontal to a final angle of greater than approximately ten below horizontal.

8. The watersports boat of claim 7, wherein the initial angle is approximately five degrees above horizontal and the final angle is approximately ten degrees below horizontal to approximately twenty-five degrees below horizontal.

9. The watersports boat of claim 3, wherein the controller is configured to automatically adjust the drive orientation while the boat speed is increased with the controller in the "surf mode" of operation once the boat speed input indicates the boat speed is above a lower speed threshold.

10. The watersports boat of claim 9, wherein the lower speed threshold is at least approximately five miles per hour (mph).

11. The watersports boat of claim 10, wherein the lower speed threshold is approximately seven mph.

12. The watersports boat of claim 9, wherein the controller is configured to cease automatically adjusting the drive orientation while the boat speed is increased with the controller in the "surf mode" of operation once the boat speed input indicates the boat speed is above an upper speed threshold.

13. The watersports boat of claim 12, wherein the upper speed threshold is at least approximately ten mph.

14. The watersports boat of claim 13, wherein the upper speed threshold is at least approximately eleven mph.

15. The watersports boat of claim 12, wherein the controller is configured to automatically adjust the drive orientation of while the boat speed is increased with the controller in the "surf mode" of operation from an initial angle of approximately one to five degrees above horizontal when below the lower speed threshold to a final angle of approximately ten to twenty-five degrees below horizontal when the upper speed threshold is reached.

16. A watersports boat comprising:

a hull having a running surface and extending between a bow and a stern;

a transverse water channeling system, the transverse water channeling system including:

a pair of water channelers mounted at the stern on opposite sides of a centerline of the hull, each of the water channelers including at least a first sidewall angled such that a trailing edge is closer to the centerline than a leading edge and a first cross wall connected to a lower end of the at least one first sidewall, each of the water channelers mounted to the stern so as to be independently movable from a stowed position to a deployed position at least partially below the running surface such that the first sidewall redirects water impinging thereon across the centerline, the first cross wall being approximately parallel with an adjacent portion of the running surface in the stowed position; and a pair of actuation assemblies, each actuation assembly operable to move a respective one of the water channelers between the stowed and deployed positions;

a controller located in the boat including at least one microprocessor and machine-readable memory receiving a side selection input, the controller being configured with program instructions to operate the actuation assembly to move the water channeler on a selected side into the deployed position.

17. A watersports boat comprising:

a hull having a running surface and extending between a bow and a stern;

a transverse water channeling system, the transverse water channeling system including:

a pair of water channelers mounted at the stern on opposite sides of a centerline of the hull, each of the water channelers including at least a first sidewall angled such that a trailing edge is closer to the centerline than a leading edge, each of the water channelers mounted to the stern so as to be independently movable from a stowed position to a deployed position at least partially below the running surface such that the first sidewall redirects water impinging thereon across the centerline; and a pair of actuation assemblies, each actuation assembly operable to move a respective one of the water channelers between the stowed and deployed positions;

a controller located in the boat including at least one microprocessor and machine-readable memory receiving a side selection input, the controller being configured with program instructions to operate the actuation assembly to move the water channeler on a selected side into the deployed position;

wherein each of the water channelers is slidably connected to the stern such that the water channeler can be raised and lowered relative to the stern;

wherein each of the actuation assemblies includes a first actuator operating between the stern and the water channeler to raise and lower the water channeler.

18. The watersports boat of claim 17, wherein each of the actuation assembly includes an intermediate plate to which the water channeler is pivotably connected such that a leading of edge of the water channeler is pivotable below a trailing edge of the water channeler;

wherein the first actuator operates between the stern and the intermediate plate to raise and lower the water channeler; and wherein each of the actuation assemblies includes a second actuator operating between the intermediate plate and the water channeler to pivot the water channeler.

19. The watersports boat of claim 18, wherein the controller is configured to operate the first actuators to place the water channelers in a lowered position with the controller in the "surf mode" of operation but prior to receipt of the side selection input and, upon subsequent receipt of the side selection input, to operate the second actuator on the selected side to move the water channeler on the selected side into the deployed position.

* * * * *